US006758376B1

(12) United States Patent
Clodfelter et al.

(10) Patent No.: US 6,758,376 B1
(45) Date of Patent: Jul. 6, 2004

(54) EDGE SEAL CLOSURE

(75) Inventors: Christopher B. Clodfelter, Evansville, IN (US); Todd E. Mathes, Evansville, IN (US)

(73) Assignee: Rexam Medical Packaging Inc., Evansville, IN (US)

( * ) Notice: Subject to any disclaimer, the term of this patent is extended or adjusted under 35 U.S.C. 154(b) by 188 days.

(21) Appl. No.: 10/191,206

(22) Filed: Jul. 9, 2002

Related U.S. Application Data

(63) Continuation-in-part of application No. 09/973,526, filed on Oct. 9, 2001, now Pat. No. 6,427,881.

(51) Int. Cl.[7] ..... B65D 47/20
(52) U.S. Cl. ..... 222/520; 222/549; 215/344
(58) Field of Search ..... 222/519, 520, 222/549, 553; 215/344

(56) References Cited

U.S. PATENT DOCUMENTS

| | | | | |
|---|---|---|---|---|
| 1,601,818 A | * | 10/1926 | Fusay | 222/520 |
| 2,998,170 A | * | 8/1961 | Manzione et al. | 222/520 |
| 2,998,902 A | | 9/1961 | Thomas et al. | |
| 3,067,916 A | | 12/1962 | Lerner | |
| 3,121,519 A | | 2/1964 | Cherba | |
| 3,261,513 A | | 7/1966 | Moran | |
| 3,317,093 A | | 5/1967 | Moran | |
| 3,326,402 A | * | 6/1967 | Randazzo | 222/520 |
| 3,351,249 A | * | 11/1967 | Stull | 222/520 |
| 3,713,586 A | | 1/1973 | Webster | |
| 3,834,596 A | * | 9/1974 | Brady et al. | 222/520 |
| 4,089,463 A | * | 5/1978 | Babiol | 215/344 |
| 4,295,584 A | | 10/1981 | Borowitz | |
| 4,583,665 A | | 4/1986 | Barriac | |
| 4,645,088 A | * | 2/1987 | Menichetti | 215/344 |
| 4,651,885 A | | 3/1987 | Gach | |
| 4,747,518 A | | 5/1988 | Laauwe | |
| 4,771,923 A | | 9/1988 | Zinnbauer | |
| 5,110,017 A | | 5/1992 | Braun | |
| 5,111,967 A | | 5/1992 | Schreiber | |
| 5,228,600 A | | 7/1993 | Steijns et al. | |
| 5,284,273 A | | 2/1994 | Schreiber | |
| 5,305,932 A | | 4/1994 | Iseli | |
| 5,456,374 A | | 10/1995 | Beck | |
| 5,465,876 A | * | 11/1995 | Crisci | 222/525 |
| 5,579,957 A | | 12/1996 | Gentile et al. | |
| 5,609,276 A | * | 3/1997 | Greatbatch | 222/520 |
| 5,931,357 A | | 8/1999 | Wass | |
| 6,056,161 A | * | 5/2000 | Brown et al. | 222/520 |
| 6,206,230 B1 | | 3/2001 | Wan et al. | |
| 6,427,881 B1 | * | 8/2002 | Clodfelter et al. | 222/521 |

FOREIGN PATENT DOCUMENTS

| | | |
|---|---|---|
| DE | 3514132 A1 | 4/1985 |
| EP | 0 558 273 A1 | 9/1993 |
| NR | 121313 | 8/1972 |
| WO | WO 96/21601 | 7/1996 |

* cited by examiner

*Primary Examiner*—Kenneth Bomberg
(74) *Attorney, Agent, or Firm*—John F. Salazar; Middleton Reutlinger

(57) ABSTRACT

A twist open/twist close edge seal closure is described wherein the closure has a sealing disc supported on the interior portion thereof which vertically rises and lowers depending on the rotation of the closure. The sealing disc has a folding finger which compresses against the sealing rib of the container to provide an adequate seal thereof and allows dispensing of the container contents around the exterior portion of the sealing disc upward through a dispensing channel and through the dispensing spout of the edge seal closure. The closure further comprises an anti-crush rib for seating on a container top wall and preventing crushing of the container neck. The container neck preferably includes a quad-lead thread having a pitch wherein a quarter rotation of the closure will open the container and allowing dispensing of the contents therein.

24 Claims, 12 Drawing Sheets

EDGE SEAL CLOSURE

CROSS-REFERENCE TO PRIOR APPLICATION

This Continuation-in-part application claims priority to U.S. patent application Ser. No. 09/973,526, filed on Oct. 9, 2001, now U.S. Pat. No. 6,427,881 which is incorporated herein by reference.

BACKGROUND OF THE INVENTION

1. Technical Field of the Invention

The present invention relates to twist open twist close edge seal closures and in particular to an edge seal closure which is threadably engaged onto a container and which has a sealing disc with folding finger located thereon for edge sealing of the container rim.

2. Discussion of the Prior Art

Many types of dispensing closures have been developed for release of liquids or like material held within a container, such as a bottle. Typically, these dispensers feature a closure which is permanently affixed to the container neck or which is threadably held thereon. More often, these closures are formed with an aperture such that, when the closure is twisted open, the aperture reveals a pathway through an interior mouth of the container. For release of liquids held within the container, the closure is twisted to the open position and the container is turned in the upside down position to allow liquid to flow through the neck and mouth of the container. However, most prior art twist open, twist close designs often leak into the threaded area of the container neck, which continues to be a problem. Thus, it is desirable to have a twist open and twist close closure which adequately seals or mates against the rim of the container and prevents these known prior art problems.

U.S. Pat. No. 5,111,967 discloses a plastic dispensing closure for a container which has a twist open, twist close design. This design however utilizes a second softer plastic to provide an effective sealing gasket around the upper portion of the closure. The application of this second softer plastic requires a dual or co-injection molding process in order to mold the closure with a hard plastic and then mold the softer plastic forming the seal thereafter. This second molding step is often prohibitively expensive, time consuming and inefficient.

In view of the deficiencies in known dispensing closures, it is apparent that a top dispensing closure is needed for use with a container wherein the closure has a linerless sealing feature, the closure raises with reduced rotation revealing a fluid communication path with the container and, the closure has a ratcheted tamper indicating band having a tamper indicating function as well as preventing closure back-off from the bottle neck.

SUMMARY OF THE INVENTION

The present invention is for an improved twist open/twist close one piece dispensing closure for use with a cooperatively structured container neck. The edge seal twist open/twist close closure of the present invention resolves many of the problems of the prior art devices noted above.

A first object of the present invention is to provide an easy to use twist open/twist close edge seal closure which allows fluid contained in the container to exit therefrom upon opening.

An additional object of the present invention is to provide a twist open/twist close edge seal closure which provides a dispensing spout extending outward from the dispensing orifice and which provides an adequate sealing disc for mating against the rim of the container top wall.

An even further object of the present invention is to provide an edge seal closure which adequately seals the neck of the container and prevents leakage of fluid or other materials in the container from dispensing around the threads of the container when the edge seal closure of the present invention is in the open or closed position.

It is an additional object of the present invention to provide a sealing disc on an edge seal twist open/twist close closure wherein the sealing disc provides a folding finger which mates against the rim of the container.

An additional object of the present invention is to provide a twist open/twist close edge seal closure which is rotatably engaged on the threads of the container neck and which has limit stops preventing the edge seal closure from rotating beyond a particular point from the container.

An even further object of the present invention is to provide a twist open/twist close edge seal closure wherein the sealing disc of the closure has ribs and spokes to support the sealing disc and provide adequate compression against the container top wall and rim such that complete sealing is effectuated when the edge seal closure is fully threaded onto the container neck.

Yet an even further object of the present invention is to provide a container having a neck and cantilevered from the neck is a top wall having a sealing rib or rim extending therefrom.

The twist open/twist close edge seal closure of the present invention provides for a twist open/twist close edge seal closure which is threadably engaged on the neck of the container, the edge seal closure having an upwardly extending spout and a side wall with a curved dispensing wall therebetween, a plurality of inwardly extending spokes which are supported against the interior side wall by a matching plurality of ribs, the spokes supporting a sealing disc therebelow, the sealing disc designed such that upon threaded application of the twist open/twist close edge seal closure onto a container, the folding finger of sealing disc compresses against the top surface of the container.

All of the above outlined objectives are to be understood as exemplary only and many other objectives of the invention may be gleaned from the disclosure herein. Therefore no limiting interpretation of the objectives noted are to be understood without further reading of the entire specification, claims and drawings included herewith.

DESCRIPTION OF THE DRAWINGS

A better understanding of the edge seal closure of the present invention may be had by reference to the attached drawings wherein like numerals referred to like elements, and wherein.

DETAILED DESCRIPTION OF THE PREFERRED EMBODIMENT

Figure 1:
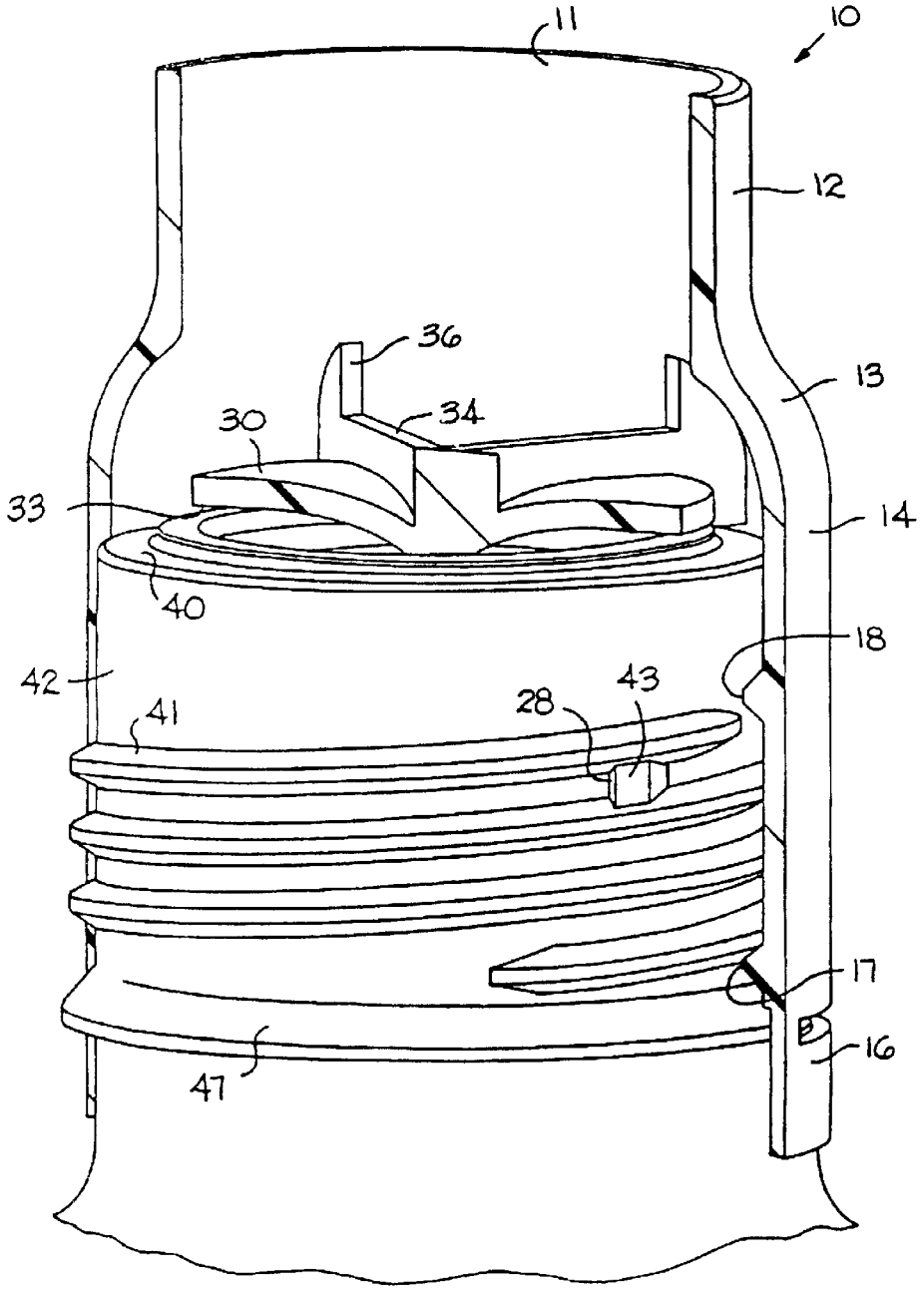
FIG. 1 is a side-sectional view of the edge seal closure of the present invention.

The twist open/twist close edge seal closure 10 of the present invention is depicted in FIG. 1. As seen therein, the edge seal closure 10 is comprised of an upper dispensing spout 12 which has a dispensing aperture 11 located at the upper most portion thereof. Additionally, the edge seal closure 10 has a lower side wall 14 which is below the spout 12 and which has a curved dispensing wall 13 interposed there between. The twist open/twist close edge seal closure 10 of the present invention may also have a tamper indicating band 16 which is frangibly connected to the lower most edge of side wall 14.

The twist open/twist close edge seal closure 10 of the present invention further has a sealing disc 30 on the interior thereof which is provided for mating against the top container wall 40. The sealing disc 30 of the twist open/twist close edge seal closure of the present invention is interposed and held in place interiorly from the outer side wall 14 of the closure and may be placed vertically in the interior portion thereof anywhere between the spout and the lower portion of the side wall inclusive.

As depicted in the present embodiment, the sealing disc 30 is interposed in the interior of the twist open/twist close edge seal closure and is suspended in place by ribs 36 and spokes 34. Ribs 36 are formed interiorly of the closure 10 and adjacent the curved dispensing wall 13 in order to provide adequate support for the sealing disc as the sealing disc 30 will be compressed against the container sealing edge 45. The sealing disc 30, as shown in the present example, is supported by plurality of spokes 34, each of the spokes correspondingly held in place and affixed to the side wall by ribs 36. The plurality of spokes 34 extend inwardly to the center hub 35 which may provide an enlarged support area for disc 30 such that adequate compression against the container top wall 40, and more particularly container sealing edge 45, may occur. Ribs 36 separate the peripheral edge of the sealing disc 30 from the inner surface of side wall 14 to produce a dispensing pathway there between. Thus, the flow dispensing material from the container may be adjusted not only by the vertical disposition of the closure on the container but also by the width of ribs 36.

Figure 2:
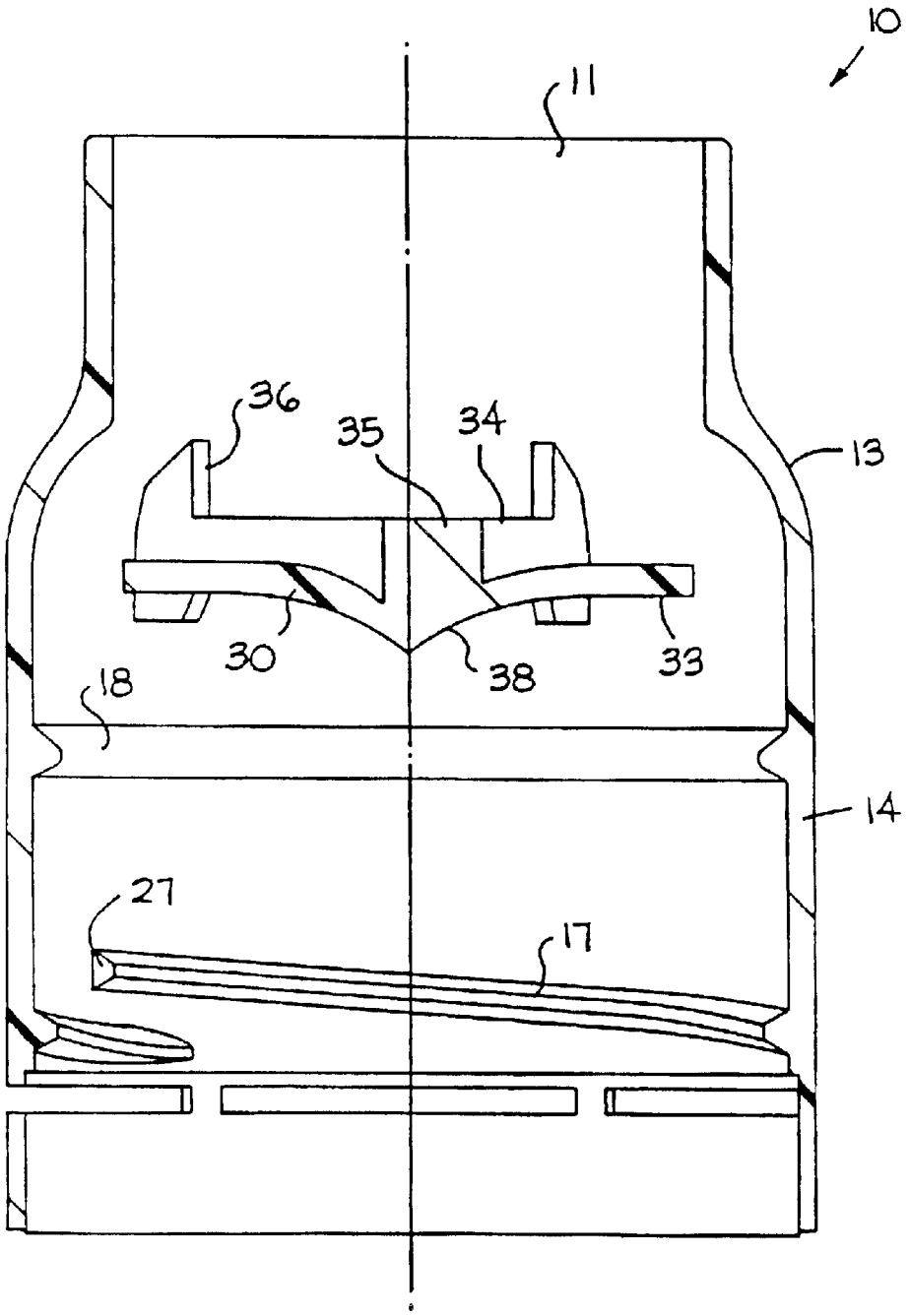
FIG. 2 is a side sectional view of the edge seal closure depicted in FIG. 1.

As depicted in the present embodiment and as is shown in FIG. 2, the sealing disc 30 is annular in order to match the annular container sealing edge 45. However, various embodiments and designs are felt to fall within the teachings and disclosure of the present invention and the teachings herein are not limited to any particular sealing disc or surface.

As shown more clearly in FIG. 2, the sealing disc 30 has a flat sealing edge 33 which is formed on the peripheral portion of the disc 30. Flat sealing edge 33 is provided such that a flat contacting surface is provided for mating against the flat container sealing edge 45 found on the container top wall 40. Adjacent flat surfaces of both the sealing disc 30 and the container sealing edge 45 is used in order that adequate sealing is provided and such that the material contained within the container is not improperly dispensed through dispensing orifice 44. Further, as can be seen from FIG. 2, the sealing disc 30 is comprised of an inner curved surface portion 38 which extends inwardly from the flat sealing edge 33 and which may depend inwardly into the dispensing orifice 44. The design of the curved surface 38 in combination with the flat sealing edge 33, the added support of center hub 35, plurality of spokes 34 and ribs 36 all of which provide adequate support such that increased compression may be brought to bear between the flat sealing edge 33 and the container sealing edge 45.

Figure 1A:
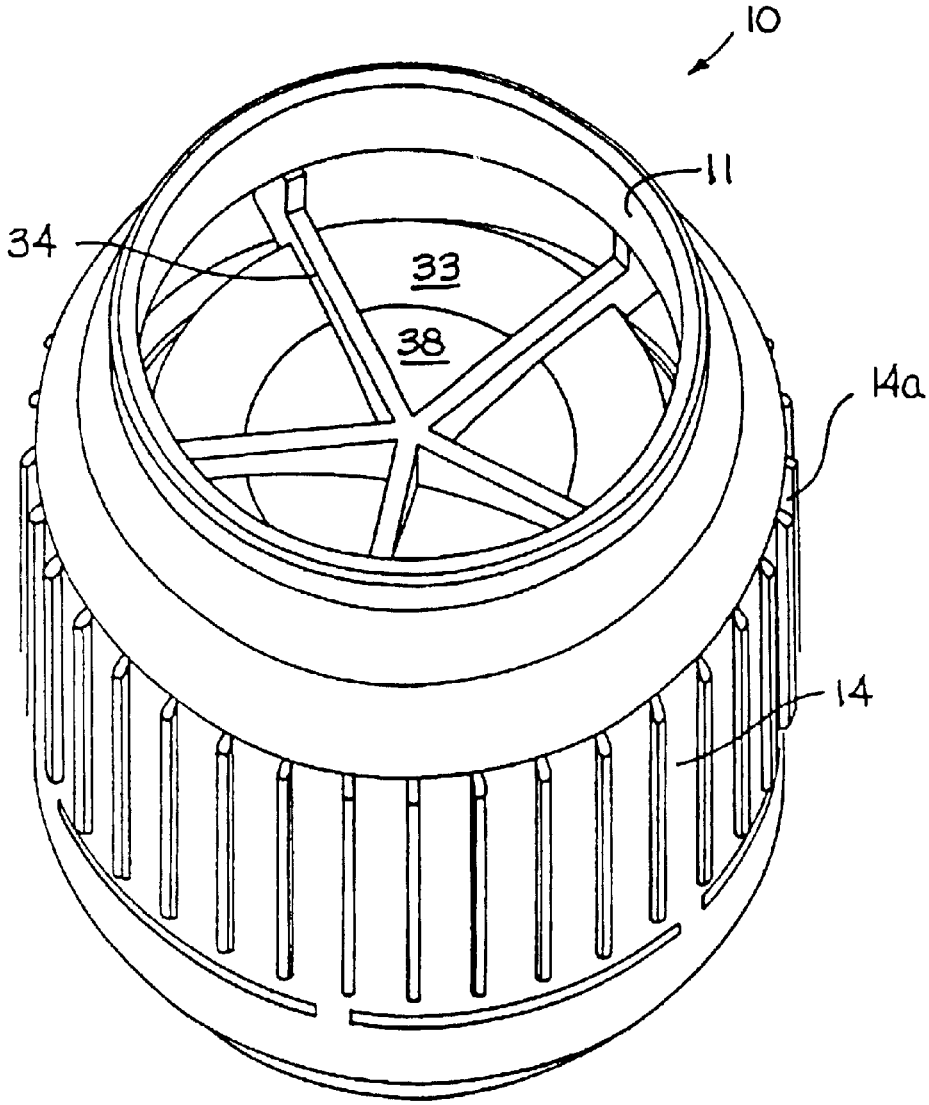
FIG. 1*a* is top perspective view of the twist open/twist close edge seal closure disclosed in FIG. 1.
Figure 3:
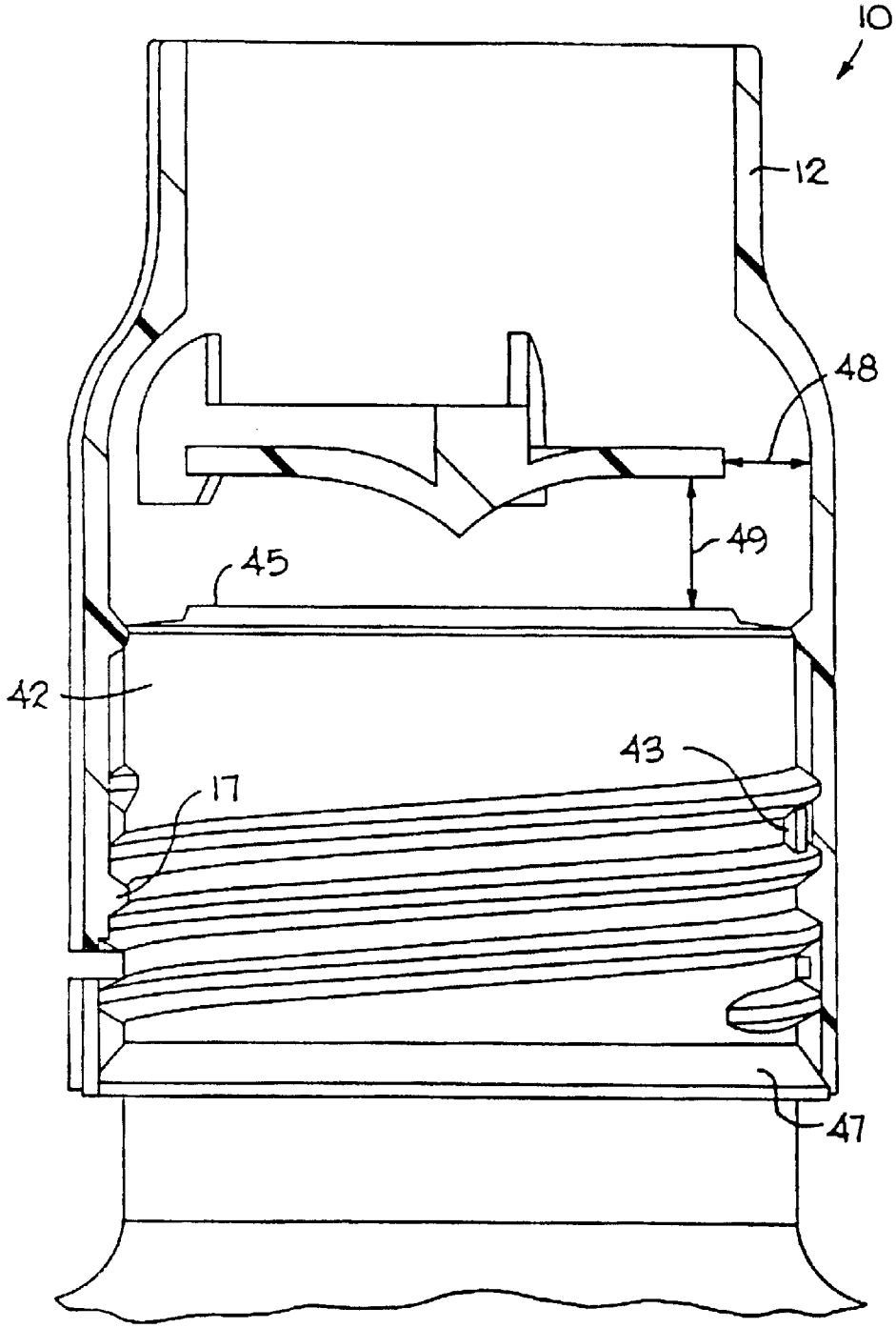
FIG. 3 is a partial side cut away view the edge seal closure and container combination depicted in FIG. 1.

As can be seen from FIG. 1*a,* and FIG. 3, the twist open/twist close edge seal closure 10 of the present invention is utilized in combination with a container having an upper side wall 44 and at least one thread 41 disposed thereon. As the edge seal closure 10 of the present invention is rotated about the upper side wall 42 and threads 41 of the container, sealing disc 30 moves vertically away from the dispensing orifice 44 of the container such that a dispensing distance 49, as depicted in FIG. 3, is provided for dispensing of material contained within the container. Continued counter-clockwise rotation raises the sealing disc 30, and the entire edge seal closure 10, away from the container neck and container sealing edge 45 and allows material contained therein to be dispensed through the dispensing orifice and upward through release channel 48 between the outer peripheral edge of sealing disc 33 and inner portion of side wall 14.

As can be seen from FIG. 3, the twist open/twist close edge seal closure 10 of the present invention is fully raised such that the material may be dispensed through release channel 48 and through the spout 12 in order to exit the dispensing aperture 11 of the closure 10. The spout 12, provided with the edge seal closure 10 of the present invention, allows for accurate dispensing of the material contents of the container while also preventing the material from leaking back on to the threads of the container. As also noted in FIGS. 1, 2 and 3, there is provided on the interior side wall of the edge seal closure a sealing bead 18 which extends inwardly to contact the upper side wall 42 of the container thereby preventing leakage of the material once dispensed from entering the area between threads 41. The sealing bead 18 may therefore extend inwardly from the side wall 14 of the edge seal closure 10 of the present invention, a sufficient distance such that a compressive seal or contact is made between the sealing bead 18 and the flat upper side wall 42 of the container.

As may also be seen from FIG. 3 and FIG. 1, a stop 43 is provided towards the upper end of threads 41 on the container which will thereby prevent continued counterclockwise rotation of the edge seal closure 10 of the present invention and to thereby prevent removal of the closure from the container. Thus, as can be clearly seen from FIG. 1, stop 43 is located towards the top end of the thread 41 and may have a flat contacting end 28. As the twist open/twist close edge seal closure 10 of the present invention is rotated in the counter-clockwise direction, thread 17 of the closure, which may have flat thread end 27 depicted in FIG. 2, will eventually contact stop 43 by abutting against flat end 28 and thereby prevent continued counter-clockwise rotation. Such position of the stop 43 may indicate the upper most dispensing distance 49 for vertical travel or disposition of the disc 30 and for the closure 10.

As may be further seen from FIG. 1, a tamper indicating (TI) band may be provided on the lower edge of the side wall 14 which may be frangibly connected to the side wall. Thus, upon initial counter-clockwise rotation of the edge seal closure 10 of the present invention, tamper indicating band 16 may contact tamper indicating bead 47 on the container in interference relationship and, as the side wall 14 rises, TI bead 47 prevents continued movement of TI band 16 thereby causing the TI band 16 to break away from the side wall 14.

As shown in FIG. 1*a,* the twist open/twist close edge seal closure of the present invention may have a plurality of vertical knurls located on the exterior of side wall 14. These plurality of knurls. 14*a* may allow easy grasp and turning by the user of the present invention in order to open and close the edge seal closure.

As is also shown in FIG. 1*a,* the sealing disc 30 is supported by the spokes 34 and further has the flat portion 33 and curved surface 38 extending inwardly therefrom. All of these areas provide adequate support and contacting surface for direct sealing of the container sealing edge 45 and closing of the dispensing orifice 44.

The edge seal closure 10 of the present invention may be made of a number of plastics or other material allowing for ease of manufacturing and use. Typical injection molding operations may be utilized to injection mold the closure and various types of plastics are available as long as the peripheral portion 33 of the sealing disc is sufficiently rigid to compressively or tightly seal the container.

Figure 4:
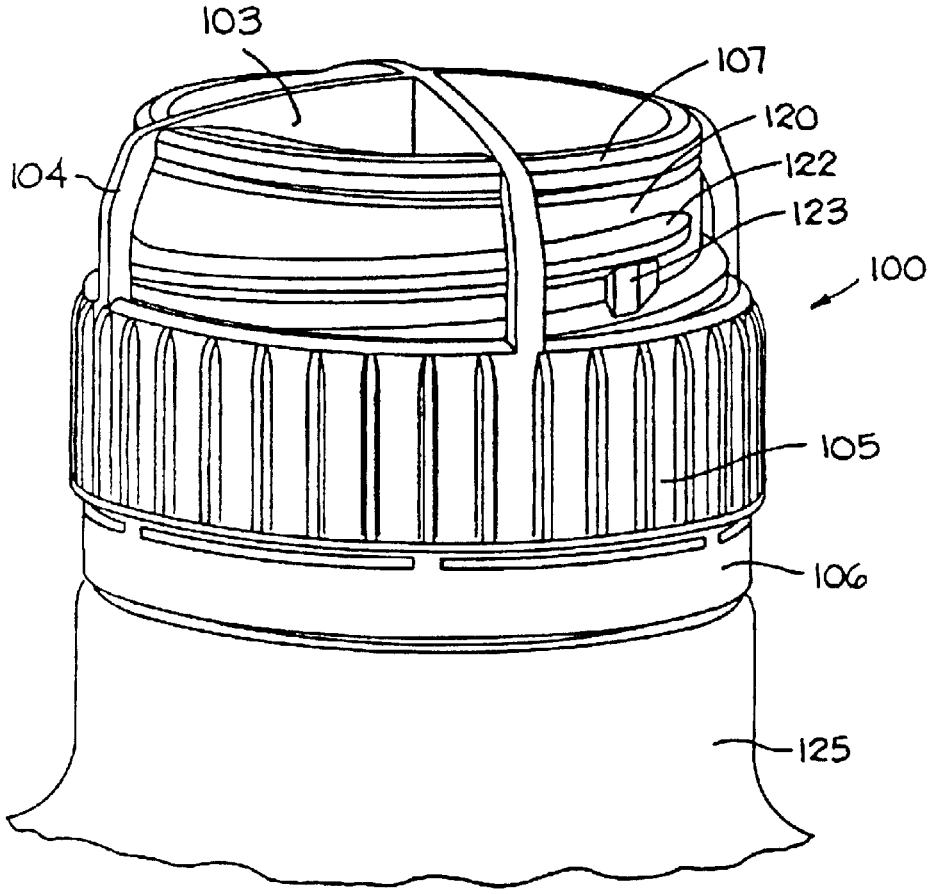
FIG. 4 is a perspective view of an alternative embodiment of the edge seal closure of the present invention.
Figure 5:
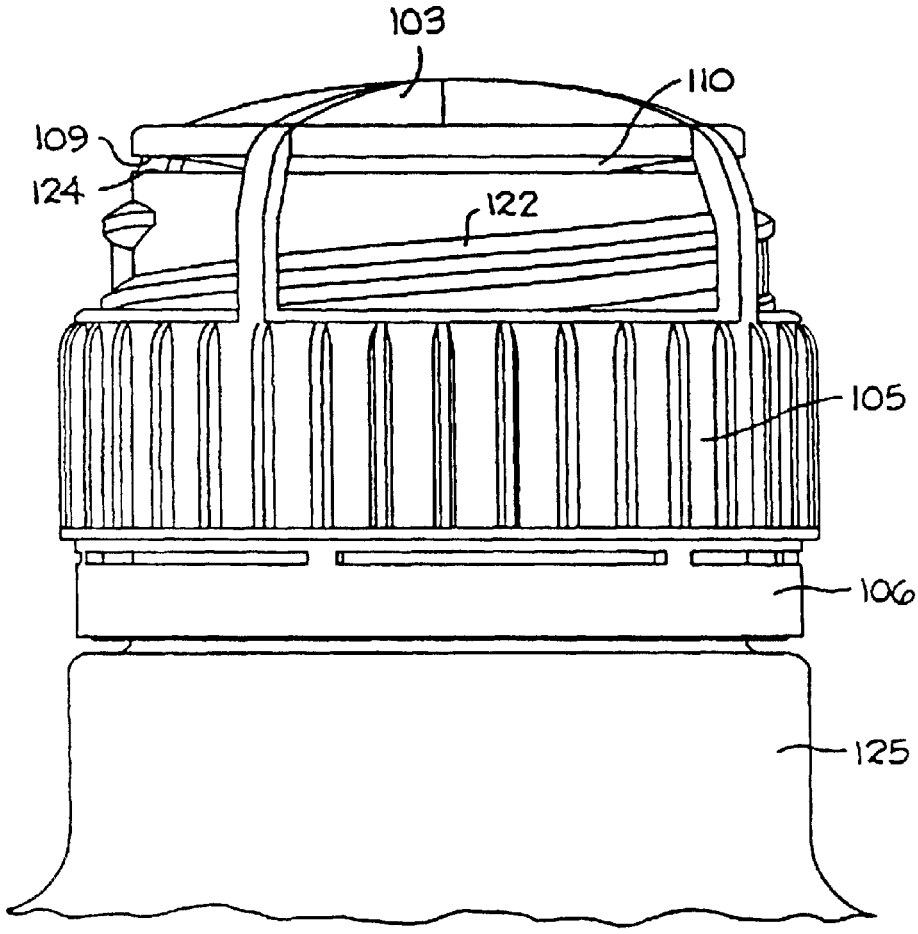
FIG. 5 is a side view of the alternative embodiment depicted in FIG. 4.
Figure 6:
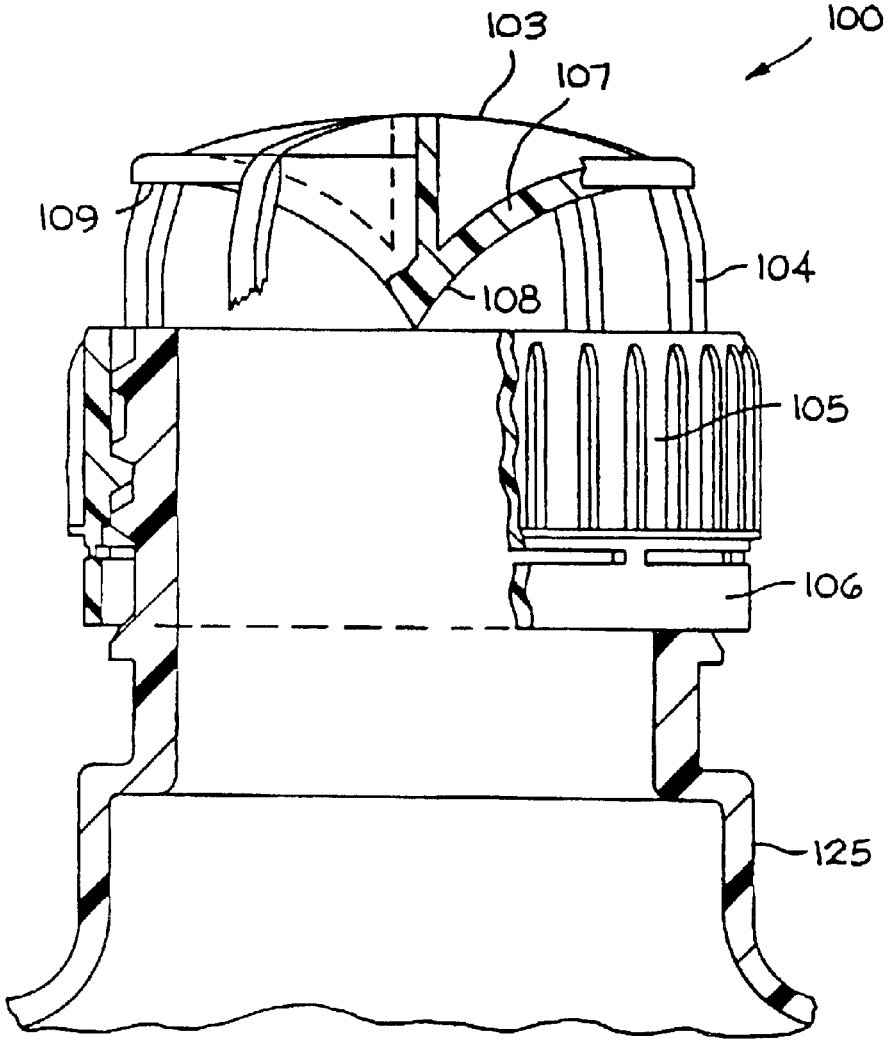
FIG. 6 is a partial side sectional view of the alternative embodiment depicted in FIG. 4.

Structures which do not require an upwardly extending spout 12 as disclosed in FIG. 1 may utilize the alternative embodiment of the sealing top 100 depicted in FIG. 4. As shown therein, the collar 105 supports a plurality of upwardly extending spokes 104 which have at their upper most portion inwardly directed supports 103. These supports, as similarly shown in the first embodiment, support along the lower edge thereof the sealing disc 107 which similarly has a flat sealing surface 109 along its outer peripheral edge and an inwardly curved depending sealing portion 108, as is depicted in FIG. 6 and FIG. 5. The flat sealing surface 109 contacts the container rib 124 such that when the collar 105 is rotated in a counter-clockwise direction, the sealing disc 107 separates from the container rim 124 and provides a dispensing channel 110 for release of the container contents. Thread 122 formed on the exterior side wall of the container allows collar 105 to threadably engage the container and vertically rise and lower thereon depending on the rotation imposed on collar 105. The threaded sealing top 100 disclosed in FIGS. 4, 5 and 6 provides an adequate twist open/twist close edge seal closure which does not require an upwardly extending spout but which provides adequate support and compressive seal against the top rim of the container while also providing a visible feedback to the user that the container is adequately closed and sealed. Further, the user may define the proper dispensing channel 110 necessary for dispensing the required amount of material contained within the container.

As is similarly shown in FIG. 1, a stop 123 is placed on container side wall 120 in between threads 122 in order to prevent full removal of the threaded sealing top 100 of this embodiment and thereby limiting the vertical displacement of the sealing disc 107 from the container rim 124. Also, the edge seal closure 100 may further have a tamper indicating band 106 placed thereon such that upon initial rotation of the collar 105 around container neck 125, tamper indicating band 106 separates from the lower most edge of collar 105.

Figure 7:
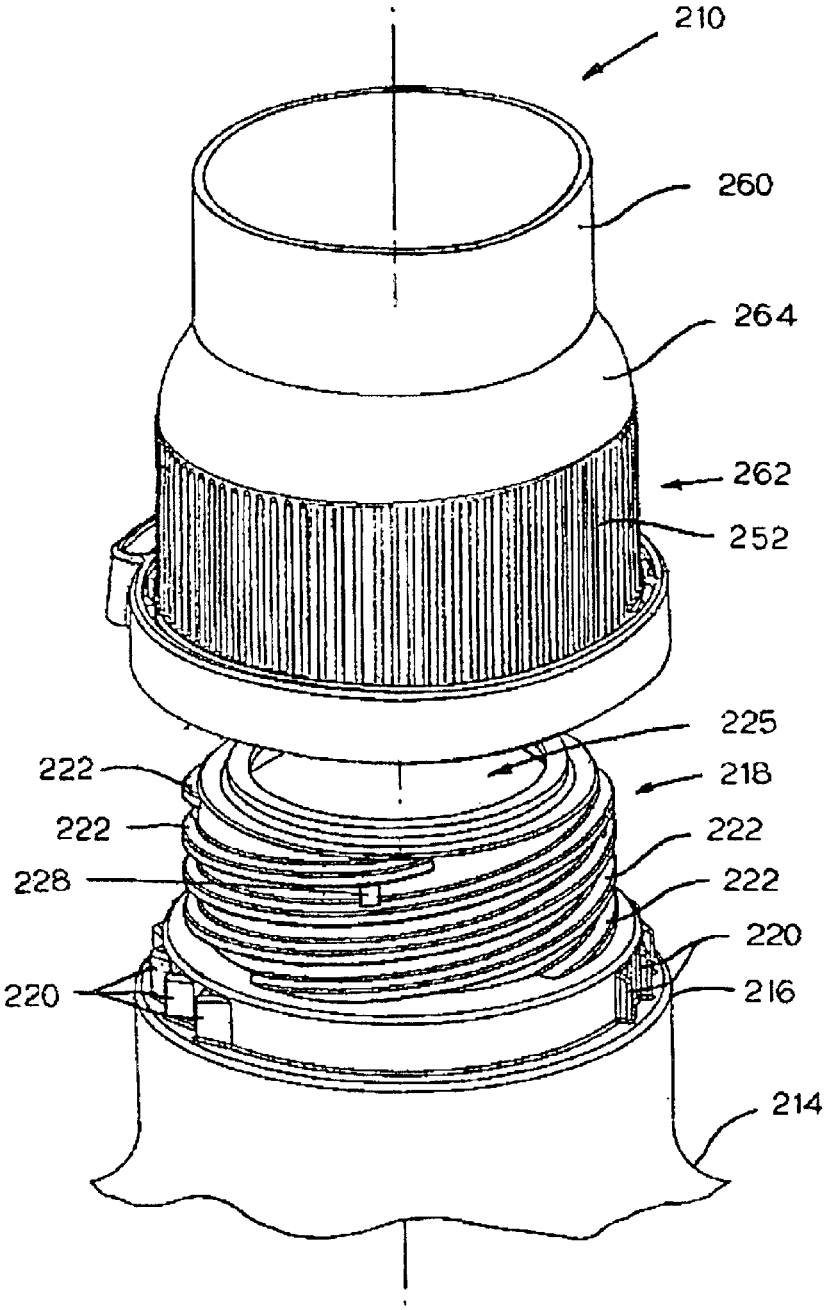
FIG. 7 shows a perspective view of an alternative embodiment of the closure and container.
Figure 8:
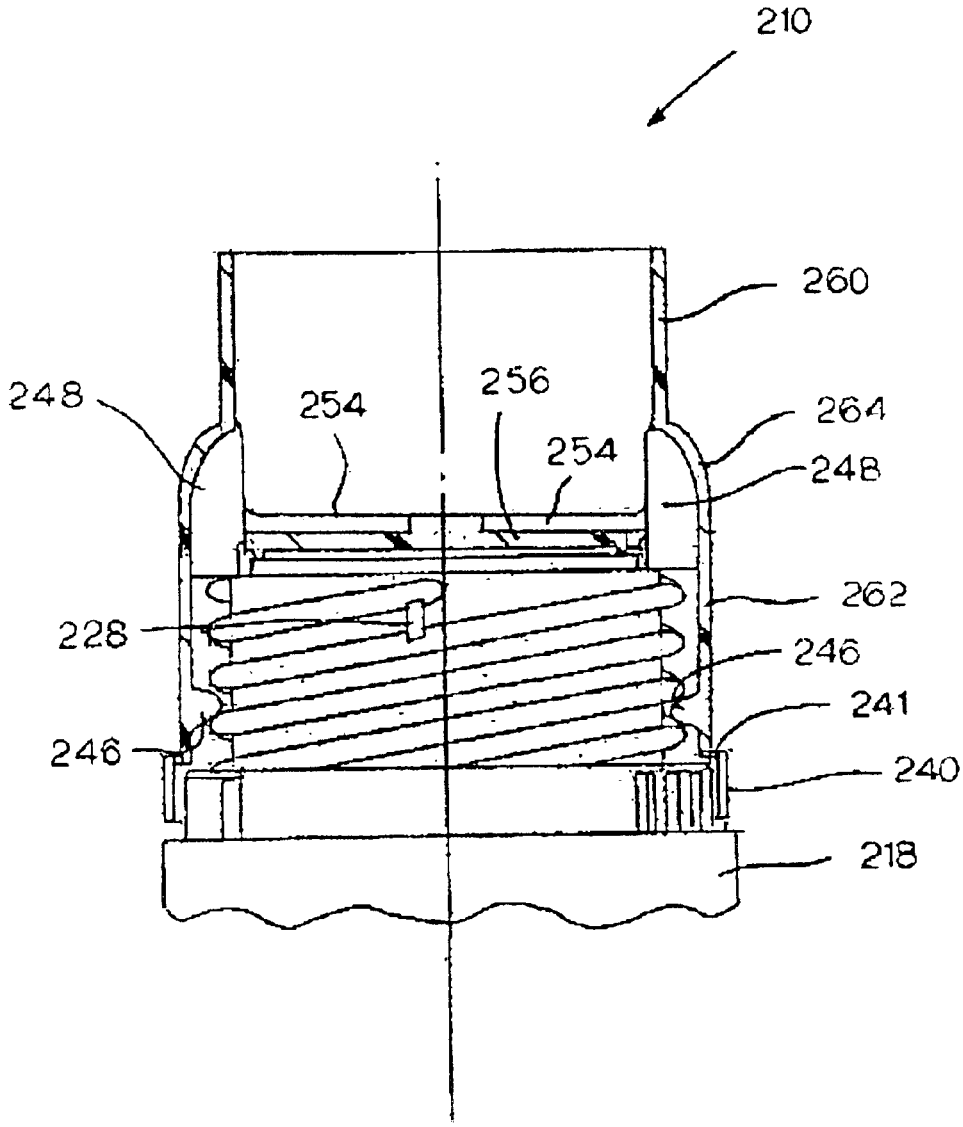
FIG. 8 shows a sectional view of the top dispense closure of FIG. 7 and a corresponding container.
Figure 9:
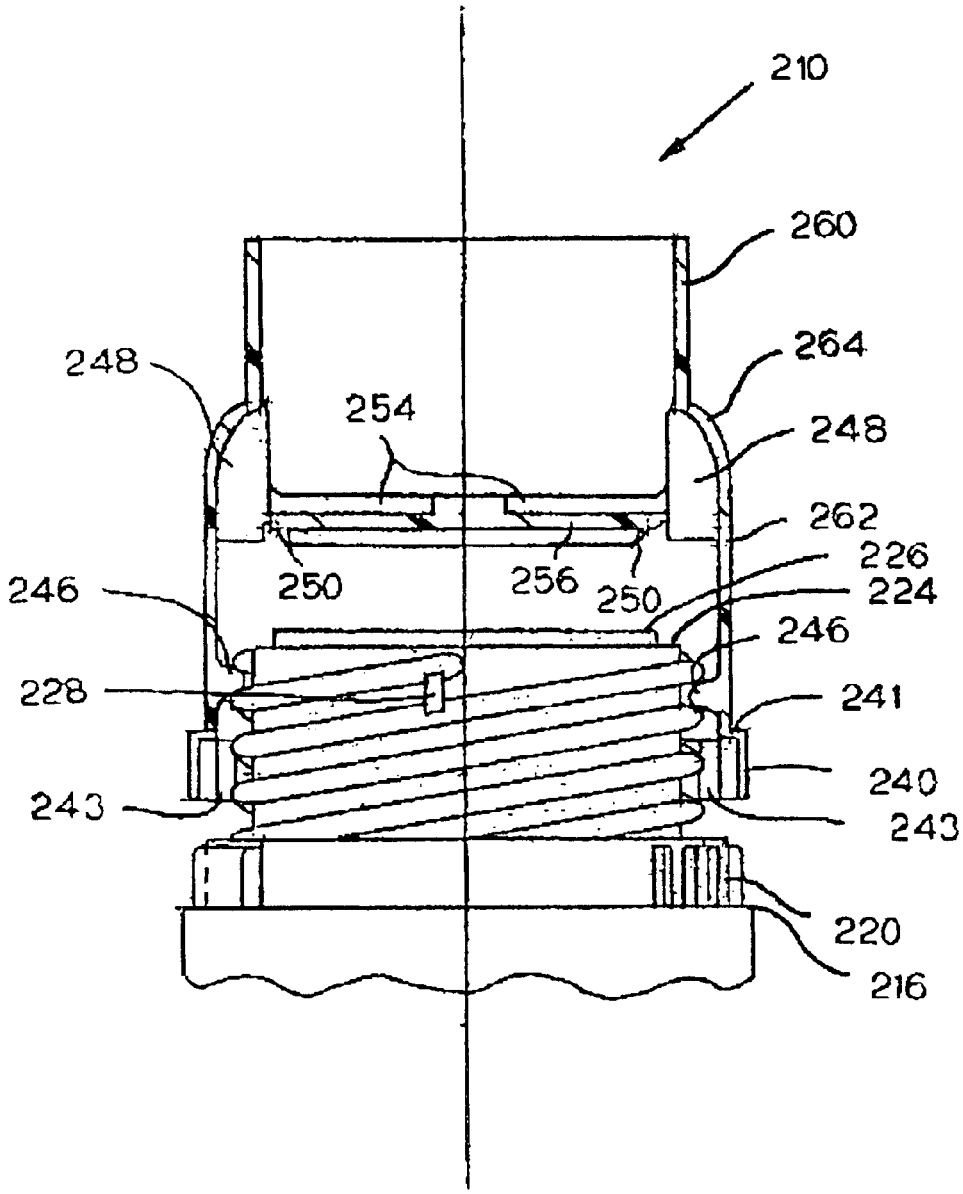
FIG. 9 shows a sectional view of the closure and container of FIG. 7 in the open position.
Figure 10:
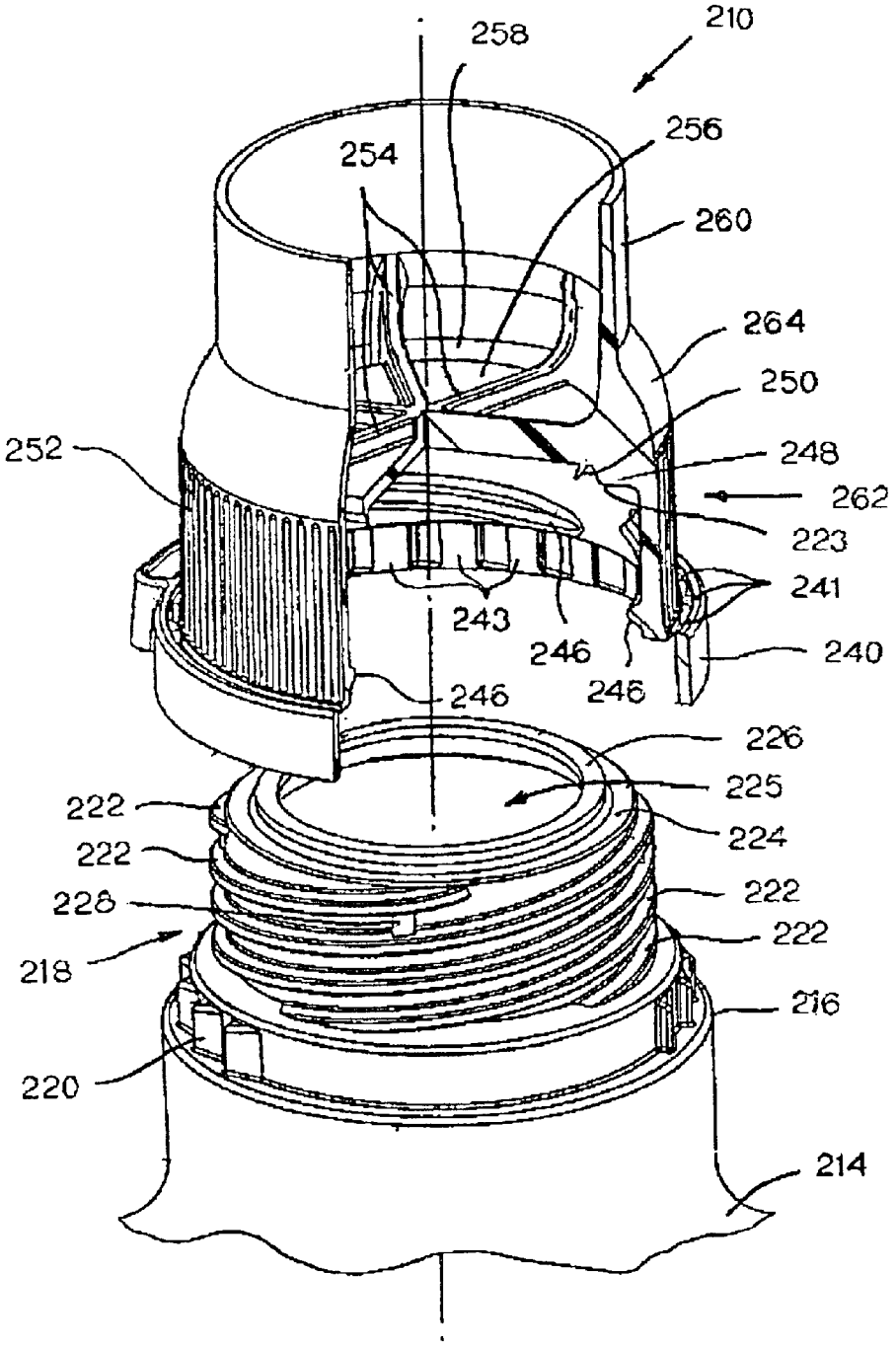
FIG. 10 shows a perspective view of the alternative closure of FIG. 7 further depicting a partial cut-away portion; and, FIG. 11 shows a sectional view of the alternative closure of FIG. 7.

Referring now to FIGS. 7 and 8, an alternative embodiment of the edge seal closure and container is shown. The twist open/twist close edge seal closure 210 has a lower side wall 262, a curved dispensing wall 264 disposed above the lower side wall 262, and a spout 260 for dispensing liquids contained within a container 214. As depicted in FIGS. 8 and 10, extending radially inward from the curved dispensing wall 264 and lower sidewall 262 are a plurality of anti-crush ribs 248, preferably six ribs 248 being equidistantly spaced. The anti-crush ribs 248 have a flat bottom surface 223 for seating on container top wall 224 and thereby prevent over-rotation of the edge seal closure 210 which may crush the upper portion of container neck 218. The anti-crush ribs 248 may extend upward and radially inward as spokes 254 to a central position within the closure 210.

Extending from an inner portion of each anti-crush rib 248 is a spoke 254. Each of the preferably six spokes 254 converge in the center of the edge seal closure 210. The spokes 254 provide strength and rigidity to closure 210 normally provided by a typical closure top wall. In turn, this allows top dispensing of the edge seal closure 210. As best seen in FIG. 10, centrally located and depending from the spokes 254 is a sealing disc 256. The sealing disc 256 in combination with a folding finger 250 prevents liquid from escaping from dispensing orifice 225. The sealing disc 256 has a circular shape and a linerless seal or folding finger 250 depending from a peripheral edge of said disc. The sealing disc 256 does not extend radially to the inner surface of the lower side wall 262. This provides an opening or fluid pathway 258 between sealing disc 256 and sidewall 262 wherein liquid contents may flow from container 214 when the closure 210 is in the open position shown in FIG. 10. The folding finger 250 extends circumferentially about the edge seal closure 210 having a diameter substantially equal to a container dispensing orifice 225. The folding finger 250 compressively seals against the container sealing rib or rim 226 inhibiting liquid escape from the container 214 when the closure 210 is rotatably threaded on the container 214. The finger 250 preferably sealably engages the sealing rib 226 of container 214 when the anti-crush ribs 248 engage container top wall 224 preventing damage to the folding finger 250 due to over-rotation of closure 210.

Figure 11:
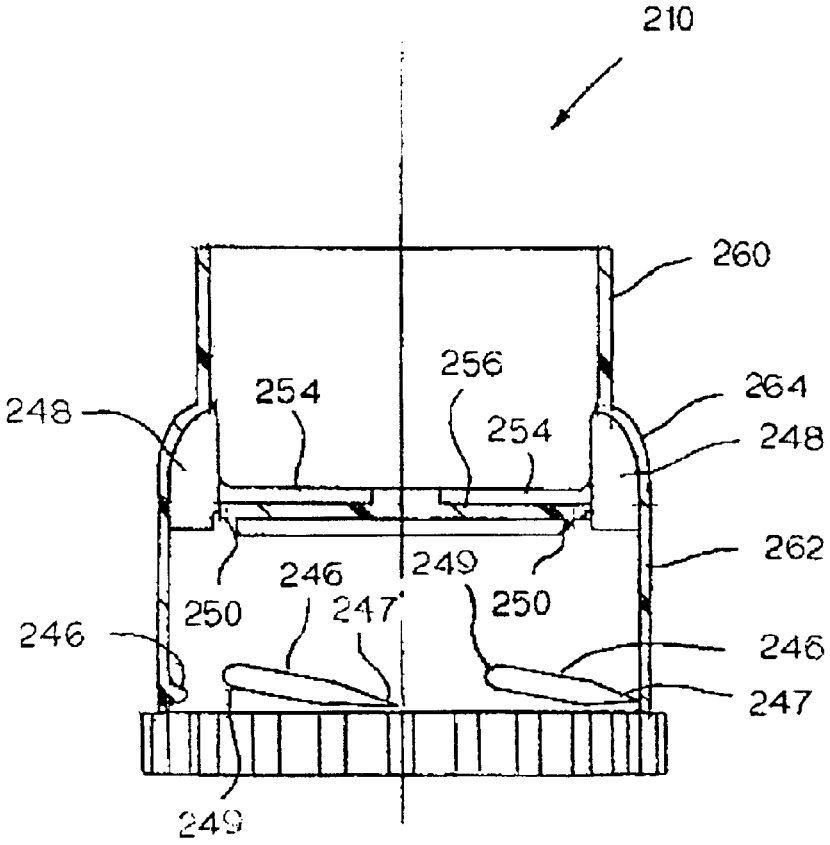

As seen in FIG. 11, on the inner portion of lower side wall 262 are preferably quad-lead threads 246, meaning there are four threads for easy application of the closure 210 on the container 214. In order to obtain a desirable quarter-turn opening characteristic, the quad-lead threads 246 preferably have a pitch of 2 threads per inch. Due to the short length of the closure threads 246, the quad-lead threads 246 are also preferable in order to provide increased contact with the container threads 222. The quad-lead threads 246 have a small first end 247 for easy starting and a blunt second end 249. The blunt second ends 249 of the quad-lead closure threads 246 contact container rotation stops 228, seen in FIGS. 7–10, extending from the container neck 218. The rotation stops 228 may be spaced apart about 180 degrees and preferably have a tapered or ramped first surface such that the quad-lead threads 246 may easily move over the stops 228 as the closure 210 is threadably rotated on the container 214. However, the container stops 228 also have a second flat surface perpendicular to the container neck 218 which the blunt end 249 of threads 246 abuts such that the threads 246 can not pass over the stops 228. This also has an advantage of providing user feedback. When the closure 210 is rotatably opened through a height necessary to reveal the fluid pathway 258, the blunt ends contact the stops 228 providing user feedback that the closure 210 is open for dispensing.

As shown in FIGS. 7 and 10, extending about the outer circumference of the lower side wall 262 are knurlings 252. The knurlings 252 enhance the grip of closure 210 to aid in twisting open or twisting close the edge seal closure 210. Beneath the knurling 252 and connected to lower side wall 262 by frangible webs 241 is a tanper indicating tear strap or band 240 shown in FIGS. 8 and 9. The frangible webs 241 also extend radially inward and downward forming ratchets 243 which engage container ratchets 220 and prevent the closure 210 from backing off the container 214 during shipping. If the closure 210 were to back-off the container 214 during, for instance, shipping the container 214 would not be sealed and contents therein would likely leak. Therefore, the tamper indication tear strap 240 performs two functions—first, it provides a tamper indicating means and second, it inhibits closure back-off associated with a two thread per inch pitch.

The container 214, as depicted in FIGS. 7 and 10 has a shoulder 216 upon which are a plurality of container ratchets 220. The ratchets 220 have a first tapered surface for allowing application of the closure 210 and a flat surface which contacts ratchets 243 to prevent back off of closure 210. The container ratchets 220 engage the tamper indicating band ratchets 241 to prevent the closure 210 from backing off the container 214. Above the shoulder 216 are quad-lead container threads 222, preferably having a pitch of two threads per inch, allowing a quarter rotation to dispose the closure 210 to an open position. The quad-lead threads 222 also allow the closure 210 to be easily started on the container 214. Disposed within the container threads 222 are the rotation stops 228, discussed above, which prevent the closure 210 from being fully removed from the container neck 218. Also included between the container threads 222 may be torque retention detents (not shown) which provide a user with feedback that the closure 210 is fully closed. The increased torque to rotate closure 210 may signal the user that the container 214 is sealingly engaged by the closure 210.

As shown in FIG. 10, above the container threads 222 is a container top wall 224 extending radially inward in a cantilevered manner from the neck 218. Extending above the container top wall 224 is the sealing rim or rib 226 which defines the dispensing orifice 225. Since the sealing rib 226 and the container top wall 224 are cantilevered radially inward from the container neck 218, over rotation of a closure may cause the container neck 218 to crush in on itself. In this embodiment however, the anti-crush ribs 248 of closure 210 are seated on container top wall 224 stopping over-rotation of closure 210, and preventing crushing of the container neck 218.

The foregoing detailed description is primarily given for clearness of understanding for the edge seal dispensing closure of the present invention and no unnecessary limitations are to be understood therefrom or from the particular examples, functions and embodiments given herein. Modifications and other variations will become obvious to those skilled in the art upon reading of the disclosure contained herein including the figures and submitted claims without parting from the spirit of the invention of this scope of the appended claims.

We claim:

1. An edge seal closure for a container, comprising:

an edge seal closure having an upper dispensing aperture and a side wall, said edge seal closure further having a sealing disc interposed within said side wall and depending from a plurality of spokes, said sealing disc separated on a peripheral edge from said side wall;

a container threadably engageable with said edge seal closure and having a neck and a top wall, a sealing rim extending from said top wall, said rim sealingly engageable with a folding finger depending from said sealing disc.

2. The edge seal closure of claim 1 further comprising anti-crush ribs extending radially inward from said sidewall to said spokes.

3. The edge seal closure of claim 1 wherein said top wall is cantilevered radially inward from said container neck.

4. The edge seal closure of claim 3, said sealing rim extending from said top wall and defining said dispensing aperture.

5. The edge seal closure of claim 4, further comprising anti-crush ribs extending from an inner portion of said closure side wall and being disposed on said container top wall when said closure is in a closed position and said folding finger is sealingly engaging said sealing rim.

6. The edge seal closure of claim 4 further comprising a spout extending upward from said side wall and having said dispensing aperture therein.

7. The edge seal closure of claim 6 wherein a container thread is a quad-lead thread.

8. The edge seal closure of claim 3 further comprising a thread on an outer surface of said container neck, said container further having a rotation stop engageable with a blunt end of a closure thread formed on an interior surface of said side wall of said edge seal closure.

9. The edge seal closure of claim 3 further comprising a thread formed on an interior surface of said closure sidewall having a blunt end operably engaging a rotation stop of said container neck.

10. The edge seal closure of claim 8 wherein said closure further has a curved dispensing wall disposed between a spout and said side wall, said spout having a diameter which is less than a diameter of said side wall.

11. The edge seal closure of claim 1 further comprising a tamper indicating tear strap having ratchets extending radially inward from an inner surface thereof.

12. The edge seal closure of claim 1 wherein a tamper indicating tear strap is frangibly connected to a lower edge of said edge seal closure.

13. An edge seal closure for a container, comprising:

an annular side wall portion, a curved wall dispensing portion thereabove, and a spout disposed above said curved wall dispensing portion;

a plurality of anti-crush ribs extending radially inward from said side wall portion and said curved wall dispensing portion;

a spoke extending radially inward from each of said plurality of anti-crush ribs and converging at an inner central location within said closure;

a sealing disc depending from said plurality of spokes and having a folding finger depending from a peripheral edge of said sealing disc.

14. The edge seal closure of claim 13 wherein said sealing disc and said side wall define an opening therebetween.

15. The edge seal closure of claim 13 further comprising quad-lead threads extending from an inner surface of said side wall of said closure.

16. The edge seal closure of claim 13 further comprising a tamper indicating tear strap band frangibly connected to said closure and having a plurality of ratchets disposed along an inner surface of said tamper indicating tear strap band.

17. The edge seal closure of claim 13, said container having an annular neck with quad-lead threads extending helically around an outer surface of said container neck.

18. The edge seal closure of claim 17 said container further having at least one rotation stop disposed on said container neck engageable with a blunt end of a closure thread.

19. An edge sealing closure for a container, comprising:

an annular side wall, a plurality of radially inwardly directed spokes extending from an interior of said annular side wall, a sealing disc depending from said spokes and having a folding finger extending about a peripheral edge of said sealing disc, anti-crush ribs disposed between said spokes and said interior of said annular side wall, an upwardly extending spout and a dispensing wall, said dispensing wall disposed between said annular sidewall and said upwardly extending spout, said annular sidewall having knurling and a tamper-indicating tear band frangibly connected thereto, said tear band having a plurality of ratchets on an inner surface thereof.

20. The edge seal closure of claim 19 said container having a neck, a top wall extending radially inward from said container neck, a sealing rib disposed above said container top wall defining a dispensing orifice, a quad-lead thread disposed on an exterior surface of said container neck, and a plurality of container ratchets on said container neck.

21. An edge seal closure, comprising:

a top dispensing closure having a plurality of interiorly disposed radially extending strengthening spokes, an annular disc depending from said spokes and having a folding finger depending from a peripheral edge of said disc, a plurality of anti-crush ribs extending from said closure sidewall between said sidewall and said spokes, and a tamper indicating tear band depending from said closure, said tear band having a plurality of ratchets extending from an inner surface thereof.

22. An edge seal closure, comprising:

a top dispensing closure having a plurality of anti-crush ribs extending from an inner portion of a sidewall portion in a spaced configuration;

said container neck having a container top wall, said container top wall cantilevered radially inward and having a sealing rib extending therefrom;

said top dispensing closure threadably connected to said container neck for vertical displacement thereon;

said anti-crush rib abutting said container top wall.

23. The edge seal closure of claim 22, further comprising a plurality of spokes extending from said anti-crush ribs, and converging at a central position within said top dispensing closure, a sealing disc depending from said spokes and having a folding finger depending from a peripheral edge of said sealing disc.

24. The edge seal closure of claim 23 wherein said folding finger compressively seals against said sealing rib.

* * * * *